US010913096B2

(12) United States Patent
Xu et al.

(10) Patent No.: US 10,913,096 B2
(45) Date of Patent: Feb. 9, 2021

(54) METHOD AND FORMER FOR NECKING AND THICKENING TUBE END

(71) Applicant: Nanchang Hangkong University (NCHU), Jiangxi (CN)

(72) Inventors: Xuefeng Xu, Jiangxi (CN); Jie Xiao, Jiangxi (CN)

(73) Assignee: Nanchang Hangkong University (NCHU), Nanchang (CN)

( * ) Notice: Subject to any disclaimer, the term of this patent is extended or adjusted under 35 U.S.C. 154(b) by 215 days.

(21) Appl. No.: 16/186,492

(22) Filed: Nov. 10, 2018

(65) Prior Publication Data

US 2019/0143386 A1 May 16, 2019

(30) Foreign Application Priority Data

Nov. 10, 2017 (CN) ..... 2017 1 1101786

(51) Int. Cl.
*B21C 1/26* (2006.01)
*B21D 37/16* (2006.01)
(Continued)

(52) U.S. Cl.
CPC ..... *B21C 1/26* (2013.01); *B21C 37/16* (2013.01); *B21D 37/10* (2013.01); *B21D 37/16* (2013.01); *B21J 1/06* (2013.01); *B21K 21/12* (2013.01)

(58) Field of Classification Search
CPC .. B21C 1/26; B21C 37/16; B21C 3/16; B21C 25/04; B21C 25/08; B21D 37/10; B21D 37/16; B21D 41/04; B21D 41/00; B21D 24/16; B21D 39/08; B21D 39/023; B21D 39/20; B21D 41/028; B21D 9/01; B21D 9/03; B21D 9/04; B21J 1/06; B21K 21/12; B21K 21/14; B21K 29/00
(Continued)

(56) References Cited

U.S. PATENT DOCUMENTS 4,616,500 A * 10/1986 Alexoff ..... B21C 37/16 72/276
9,364,987 B2 * 6/2016 Stewart ..... B29C 48/87
(Continued)

FOREIGN PATENT DOCUMENTS

CN 107639172 A 1/2018
JP H07214148 A 8/1995

*Primary Examiner* — Shelley M Self
*Assistant Examiner* — Teresa A Guthrie
(74) *Attorney, Agent, or Firm* — Wayne & Ken, LLC; Tony Hom

(57) ABSTRACT

A method and a former for necking and thickening a tube end. The former includes a hydraulic cylinder, a pusher, a concave die, a filler block, a plurality of heating rods and a heating device. The hydraulic cylinder is connected to a disc provided with a guide sleeve. The pusher is provided on the hydraulic cylinder and passes through the guide sleeve. The concave die is provided at a side of the pusher and includes a mold cavity and a plurality of heating holes. The filler block is provided in the mold cavity. The heating rods are provided in the heating holes connected to the heating device. The filler block includes a tapered portion provided at one end of the filler block and a diameter-reduced portion. The tapered portion is threadedly connected to the diameter-reduced portion. An ejector pin is provided at one end of the diameter-reduced portion.

8 Claims, 6 Drawing Sheets

(51) Int. Cl.

| | |
|---|---|
| ***B21D 37/10*** | (2006.01) |
| ***B21C 37/16*** | (2006.01) |
| ***B21K 21/12*** | (2006.01) |
| ***B21J 1/06*** | (2006.01) |

(58) Field of Classification Search
USPC .... 72/342.8, 370.12, 370.16, 370.15, 370.14
See application file for complete search history.

(56) References Cited

U.S. PATENT DOCUMENTS

| | | | | |
|---|---|---|---|---|
| 9,623,476 | B2 * | 4/2017 | Choda | B21J 13/03 |
| 2001/0035038 | A1 * | 11/2001 | Ose | B21D 41/04<br>72/316 |
| 2010/0139356 | A1 * | 6/2010 | Brochheuser | B21D 41/00<br>72/342.7 |
| 2013/0305803 | A1 * | 11/2013 | Wiget | B21D 41/00<br>72/370.1 |

* cited by examiner

METHOD AND FORMER FOR NECKING AND THICKENING TUBE END

CROSS-REFERENCE TO RELATED APPLICATIONS

This application claims to Chinese Application No. 201711101786.6 with a filing date of Nov. 10, 2017. The content of the aforementioned applications, including any intervening amendments thereto, are incorporated herein by reference.

TECHNICAL FIELD

The present disclosure relates to plastic processing of tubes, and more particularly to a method and a former for necking and thickening an aluminum alloy tube end.

BACKGROUND

Necking process is a forming method for reducing the diameter of the mouth of a tube blank. As one of the tube plastic processing techniques, the necking process is widely used in the manufacture of structural parts in aerospace, national defense, light industry, and the like.

Currently, processes for necking a tube end neglect the problem of work hardening and thickness after necking the tubes. Therefore, there is no significant thickening in a radial direction of necking after the tube is formed, and the necked tube need to be welded or riveted to other components in the following stages. At present, the forming of the pull rod in the aircraft control mechanism is achieved by necking the pull rod and then riveting it with the threaded sleeve, resulting in low joint strength, heavy weight and high cost of the aircraft, which should be strongly avoided in the aircraft manufacturing industry.

In China and other countries, researches on necking and thickening process mainly introduces a method of thickening a tube end and then necking the tube end. However, this increases the production cost and reduces the production efficiency, and it is difficult to neck the tube end after it is thickened.

SUMMARY

The present disclosure is to provide a former for necking and thickening a tube end, and a method of necking and radially thickening the tube end using differential temperature through hot extrusion. In this method, the tube end is directly tapped at a necking portion after being thickened in a radial direction, instead of being riveted to the threaded sleeve. This can significantly increase the joint strength of the pull rod of an aircraft and the material efficiency, and reduce the component weight and machining allowance as well as the processing and production costs.

The present disclosure provides a former for necking and thickening a tube end including: a hydraulic cylinder, a pusher, a concave die, a filler block, a plurality of heating rods, and a heating device; wherein the hydraulic cylinder is connected to a disc; a guide sleeve is provided on the disc; the pusher is provided on the hydraulic cylinder and passes through the guide sleeve; the concave die is provided at a side of the pusher; the concave die includes a mold cavity and a plurality of heating holes; the filler block is provided in the mold cavity; the plurality of heating rods are provided in the plurality of heating holes; and the plurality of heating rods are connected to the heating device.

The filler block includes a tapered portion and a diameter-reduced portion; the tapered portion is provided at a first end of the filler block; the tapered portion is threadedly connected to the diameter-reduced portion; and an ejector pin is further provided at an end of the diameter-reduced portion.

Preferably, a cooling device is further provided between the hydraulic cylinder and the concave die. The cooling device and the concave die are both provided on a connecting plate. A through hole is provided on the cooling device and has an inner diameter equal to an inner diameter of the mold cavity. An axial center of the pusher, an axial center of the mold cavity and a center of the through hole of the cooling device are in alignment.

Preferably, the cooling device abuts against one end of the concave die. A baffle plate is provided on the other end of the concave die. The baffle plate abuts against the ejector pin. A liquid inlet is provided at a bottom of the cooling device, and a liquid outlet is provided at a top of the cooling device.

Preferably, the baffle plate and the concave die are provided with the plurality of heating holes which are distributed along a circumference of the mold cavity. The baffle plate and the concave die are provided with a plurality of thermometer holes between the adjacent heating holes.

Preferably, a thermocouple is provided in the plurality of thermometer holes in the concave die. The heating device includes a temperature controller, an air switch and a contactor. The thermocouple is electrically connected to the temperature controller. The temperature controller is connected to the contactor through the air switch, and the contactor is electrically connected to the plurality of heating rods.

Preferably, one end of the filler block is a cylinder. One end of the cylinder and one end of the tapered portion are integrally formed and have the same diameter. The other end of the tapered portion and a diameter-reduced end of the diameter-reduced portion are connected and have the same diameter. The other end opposite to the diameter-reduced end of the diameter-reduced portion is connected to the ejector pin. The ejector pin is provided with an ejection rod having a diameter larger than the diameter of the diameter-reduced end of the diameter-reduced portion.

The present disclosure further provides a method for necking and thickening a tube end using the former, including:

step 1: cutting a tube blank with a length with a tube cutter;

wherein an end face of the cut tube blank is perpendicular to a tube axis and is smooth without burr;

step 2: fixing the cooling device and the concave die to the connecting plate through a thread connection; threadedly connecting the baffle plate to the concave die, wherein the cooling device and the concave die are in close contact, and an axial hole of the cooling device is aligned with an axial hole of the mold cavity;

connecting the hydraulic cylinder to the disc connected to the pusher; connecting the pusher to the guide sleeve connected to the tube blank in an embedded manner; threadedly connecting the filler block to the ejector pin; placing the filler block in the mold cavity, wherein a diameter-reduced end of the ejector pin passes through an axial hole of the baffle plate; the axial hole of the cooling device is adjusted to be aligned with the axial hole of the mold cavity; and the former has an axial center aligned with an axis of the hydraulic cylinder;

step 3: supplying cooling liquid to the cooling device; connecting the liquid inlet and the liquid outlet to a plastic tube, respectively, wherein the cooling liquid flows into the liquid inlet and flows out of the liquid outlet;

inserting the plurality of heating rods and the thermocouple into the plurality of heating holes and the plurality of thermometer holes, respectively; powering the heating device; setting a target temperature on the temperature controller for heating the tube blank; and preheating the concave die;

step 4: after the concave die is preheated, pushing the tube blank with the hydraulic cylinder to pass through the cooling device and then slowly enter into the concave die at high temperature, wherein a feeding speed of the hydraulic cylinder is controlled with a console, and the tube blank is necked and thickened by controlling a feeding displacement of the tube blank; and step 5: powering off after the processing is completed; stopping supplying the cooling liquid and taking out the filler block to obtain the formed tube end.

Preferably, in step 4, according to volume constancy, the length of the tube blank for necking the tube blank is calculated; then the length of the tube blank for thickening the tube blank is calculated; and the feeding displacement of the tube blank is calculated.

Preferably, in step 4, the temperature of the concave die is controlled with the temperature controller using the thermocouple. When the temperature is lower than the target temperature, the contactor is controlled by the temperature controller to continue to heat the concave die to the target temperature through the plurality of heating rods.

The present disclosure achieves the following technical effects as compared with the prior art:

1. The former of the present disclosure is simpler. The forming method improves the material efficiency and reduces the machining allowance as well as the processing and production cost.

2. The cooling device of the present disclosure is affected by the heat transfer effect in the forming process. The temperature of the tube blank outside the concave die rises as the heating temperature of the concave die rises. The tube blank outside the concave die becomes unstable due to the increase of thermoplasticity without any protection. The cooling device not only protects the tube blank, but also plays a role in cooling the tube blank, so that the tube in the concave die and the tube outside the concave die produce a significant temperature difference effect under the cooling effect of the cooling device. This effectively prevents the tube blank outside the concave die from being unstable. The cooling liquid in the cooling device is circulating water with a better cooling effect compared to the compressed air.

3. The concave die of the present disclosure is provided with a detachable filler block. The filler block includes a diameter-reduced portion and a tapered portion. The diameter-reduced portion is configured to ensure the inner diameter of the thickening portion of the diameter-reduced end of the tube and is threadedly connected to the tapered portion. The diameter-reduced portion with different diameters can be easily replaced according to the manufacturing requirements. When the tube blank is slowly transited from the straight tube end to the tapered area of the concave die, the tube blank is susceptible to the axial compressive stress and becomes unstable since the tapered area is an abrupt area for necking the tube blank, leading to inward recess of the tube blank. The tapered portion of the filler block supports the tube blank in the abrupt area, and effectively prevents the tube blank from being depressed inwardly due to the axial compressive stress.

4. The present disclosure optimizes the structure of the concave die. A lead end of the forming hole is lengthened, allowing for the preheating of the tube blank before the necking and thickening process. The diameter-reduced end is shortened. To achieve the expected thickening, in the case of a diameter-reduced end with a longer length, more tube materials to fill into the concave die are required according to the volume constancy, and a long forming time is accordingly required. Therefore, lengthening the lead end of the forming hole and shortening the diameter-reduced end will be efficient to the necking and thickening of the tube blank.

BRIEF DESCRIPTION OF THE DRAWINGS

The drawings will be briefly described below to more clearly illustrate the embodiments of the present disclosure or the technical solutions in the prior art. Obviously, the drawings are only illustrative of the present disclosure. For those skilled in the art, other drawings may be obtained without any creative work.

Figure 1:
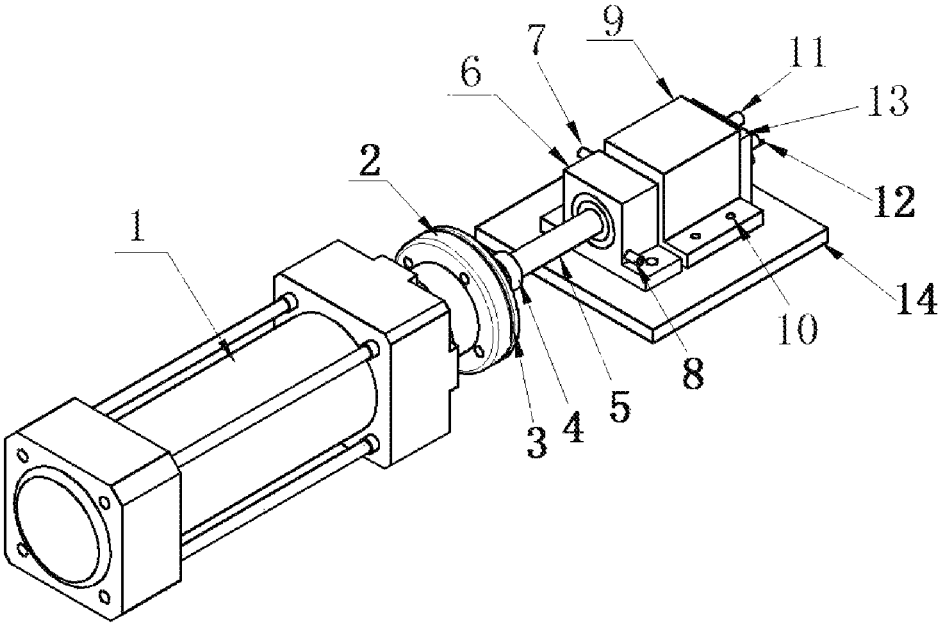
FIG. 1 is a schematic diagram of a former for necking and thickening a tube end according to an embodiment.

Reference numerals: 1, hydraulic cylinder; 2, disc; 3, pusher; 4, guide sleeve; 5, aluminum alloy tube blank; 6, cooling device; 7, liquid outlet; 8, liquid inlet; 9, concave die, 10; threaded connection hole; 11, heating rod; 12, thermocouple; 13, baffle plate; 14, connecting plate; 15, filler block; 16, heating hole; 17, mold cavity; 18, ejector pin; 19, thermometer hole; 20, diameter-reduced portion; 21, tapered portion; 22, connection box; 23, contactor; 24, air switch; and 25 temperature controller.

DETAILED DESCRIPTION OF EMBODIMENTS

The technical solutions in the embodiments of the present disclosure are clearly and completely described below with reference to the accompanying drawings. It is obvious that the described embodiments are not all the embodiments of the present disclosure. All other embodiments obtained by those skilled in the art based on the embodiments of the present disclosure without creative efforts fall within the scope of the present disclosure.

The object of the present disclosure is to provide a former for necking and thickening a tube end, and a method for necking and radially thickening a tube using differential temperature through hot extrusion. In this method, the tube is directly tapped at a necking portion after being thickened in a radial direction, instead of being riveted to the threaded sleeve. This can significantly increase the joint strength of the pull rod of the aircraft, and reduce the component weight.

To make the features and advantages clearer and more understandable, the present disclosure will be further described in detail with reference to the drawings and specific embodiments.

Example 1

As shown in FIGS. 1-5 and 6A-6B, this embodiment illustrates the principle of the method for necking and thickening a tube end and a former for necking and thickening the tube end of the present disclosure. In this embodiment, the aluminum alloy tube is taken as an example to be formed through differential temperature.

As shown in FIG. 1, this embodiment provides a former for necking and thickening a tube end, including a hydraulic cylinder 1, a pusher 3, a concave die 9, a filler block 15, a plurality of heating rods 11 and a heating device 6. The hydraulic cylinder 1 serves as a main power source to generate a pressing force for forming the aluminum alloy tube blank 5. The working end of the hydraulic cylinder 1 is screwed with a disc 2, and the disc 2 is provided with a guide sleeve 4. The pusher 3 is provided on the hydraulic cylinder 1 and passes through the guide sleeve 4, and the guide sleeve 4 is configured to fix the axial position of the aluminum alloy tube blank 5 to stabilize the shape of the connecting end of the aluminum alloy tube blank 5.

Figure 2:
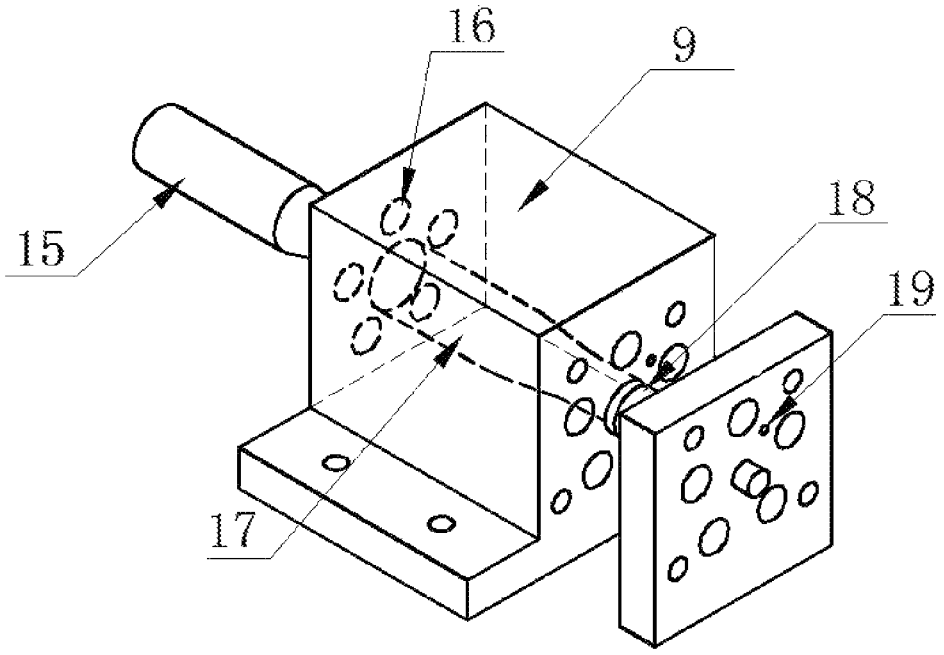
FIG. 2 is a schematic diagram of a concave die of the former for necking and thickening the tube end according to the embodiment.

As shown in FIG. 2, the concave die is provided at a side of the pusher. A cooling device 6 is provided between the hydraulic cylinder 1 and the concave die 9. The cooling device 6 and the concave die 9 are provided on a connecting plate 14. Threaded connecting holes 10 are provided on the connecting plate 14. The cooling device 6 and the concave die 9 are both threadedly connected to the connecting plate 14. The cooling device 6 abuts against one end of the concave die 9. The cooling device 6 is tightly disposed with the concave die 9. The cooling device 6 is provided with a through hole having an inner diameter equal to the inner diameter of a forming hole of a mold cavity 17, and the axial center of the pusher 3, the axial center of the mold cavity 17 and the center of the through hole of the cooling device 6 are in alignment to ensure the processing of the aluminum alloy tube blank 5 in a linear feeding manner.

Under the heat transfer effect, the temperature of the aluminum alloy tube blank 5 outside the concave die 9 rises as the heating temperature of the mold rises. The aluminum alloy tube blank 5 outside the concave die 9 becomes unstable due to the increase in thermoplasticity without any protection. The cooling device 6 not only protects the tube blank, but also cools the aluminum alloy tube blank 5, so that the tube in the concave die 9 and the tube outside the concave die 9 generate a significant temperature difference with the cooling effect of the cooling device 6, which effectively prevents the aluminum alloy tube blank 5 outside the concave die 9 from being unstable. Specifically, a liquid inlet 8 is provided at the top of the cooling device 6, and a liquid outlet 7 is provided at the bottom of the cooling device 6. The cooling liquid in the cooling device 6 is circulating water with a better cooling effect as compared to the compressed air.

Specifically, the concave die 9 includes a mold cavity 17 and a plurality of heating holes 16. A filler block 15 is provided in the mold cavity 17. The plurality of heating rods 11 are provided in the plurality of heating holes 16 and are connected to the heating device. The concave die 9 is configured to neck and thicken the aluminum alloy tube blank 5 through hot extrusion. The mold cavity 17 and the filler block 15 in the concave die 9 are both configured to neck and thicken the aluminum alloy tube blank 5.

Figure 3:
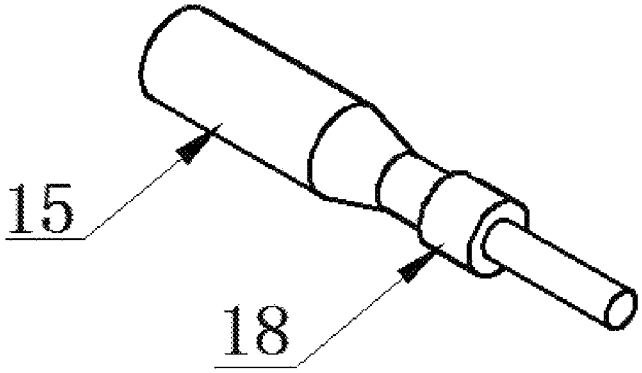
FIG. 3 is a schematic diagram of a filler block of the former for necking and thickening the tube end according to the embodiment.
Figure 4:
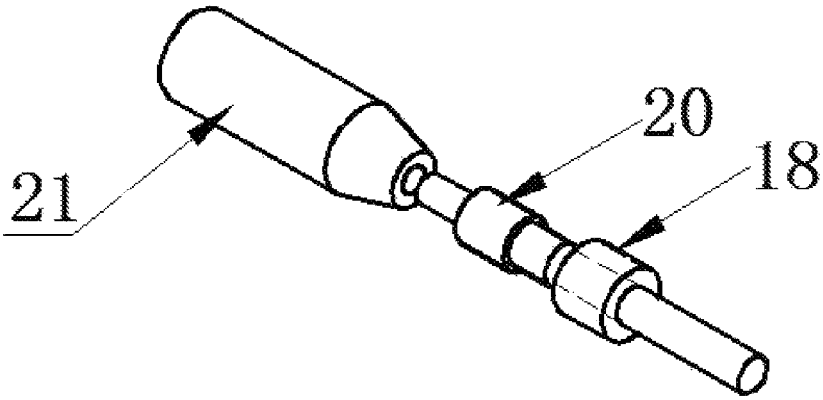
FIG. 4 is a schematic diagram of the filler block of the former for necking and thickening the tube end according to the embodiment.

As shown in FIGS. 3-4, the filler block 15 includes a tapered portion 21 and a diameter-reduced portion 20, which are threadedly connected. The diameter-reduced portion with different diameters can be easily replaced according to the manufacturing requirements. The tapered portion 21 is provided at one end of the filler block 15 and is connected to the diameter-reduced portion 20. An ejector pin 18 is further provided at one end of the diameter-reduced portion 20. Specifically, the other end of the filler block 15 is a cylinder. The cylinder is configured to sleeve the aluminum alloy tube blank 5 and is the lead end of the forming hole of the concave die 9. Lengthening the lead end and shortening the diameter-reduced end will be efficient to neck and thicken the tube blank. One end of the cylinder and one end of the tapered portion 21 are integrally formed and have the same diameter, and the other end of the tapered portion 21 and a diameter-reduced end of the diameter-reduced portion 20 are connected and have the same diameter. The cross-sectional radius of the tapered portion 21 and the corresponding mold cavity 17 are sequentially reduced for necking the aluminum alloy tube blank 5, then the aluminum alloy tube blank 5 is pushed into the diameter-reduced end. The cross-sectional diameter of the diameter-reduced end is constant, and the diameter-reduced end is configured to ensure the inner diameter of the thickening portion of the aluminum alloy tube blank 5. When the aluminum alloy tube blank 5 is slowly transited from the straight tube end to the tapered area of the concave die 9, the aluminum alloy tube blank 5 is susceptible to the axial compressive stress and becomes unstable since the tapered area is an abrupt area for necking the tube blank, leading to inward recess of the aluminum alloy tube blank 5. The tapered portion 21 of the filler block 15 not only supports the tube blank in the abrupt area, but also effectively prevents the aluminum alloy tube blank 5 from being depressed inwardly due to the axial compressive stress.

The other end opposite to the diameter-reduced end of the diameter-reduced portion is connected to the ejector pin 18. An ejection rod is provided on the ejector pin 18, and the diameter of the ejection rod is larger than the diameter of the diameter-reduced end. The ejection rod is configured to withstand the aluminum alloy tube blank 5 for thickening the aluminum alloy tube blank 5 after being necked. According to the volume constancy, the length of the aluminum alloy tube blank 5 for necking the aluminum alloy tube blank 5 is calculated; then the length of the aluminum alloy tube blank 5 for thickening the aluminum alloy tube blank 5 is calculated; and the feeding displacement of the tube blank is calculated. In this way, the aluminum alloy tube blank 5 can be specifically thickened.

A baffle plate 13 is provided at the other end of the concave die 9. The baffle plate 13 abuts against the ejector pin 18, so that the baffle plate 13 can withstand the ejector pin 18 to thicken the aluminum alloy tube blank 5. The baffle plate 13 and the concave die 9 are provided with a plurality of heating holes 16 which are distributed along the circumference of the mold cavity 17. The baffle plate 13 and the concave die 9 are further provided with a plurality of thermometer holes 19 between the adjacent heating holes. The plurality of heating holes 16 are configured to uniformly heat the aluminum alloy tube blank 5. 8-12 of the plurality of heating holes 16 may be provided, and 8 of the plurality of heating holes 16 are provided in this embodiment. The plurality of thermometer holes 19 are used for better detecting the temperature of the concave die 9 without causing local error. The plurality of thermometer holes 19 are evenly disposed between the mold cavity 17 and the plurality of heating holes 16 so that the temperature outside the mold cavity 17 and the temperature transmitted by the plurality of heating rods 11 can be detected. The plurality of thermometer holes 19 can also be disposed at the symmetrical end of the mold cavity 17 with respect to the plurality of heating holes 16 to detect the relative temperature transmitted into the mold cavity 17 by diminishing the radiant heat.

Figure 5:
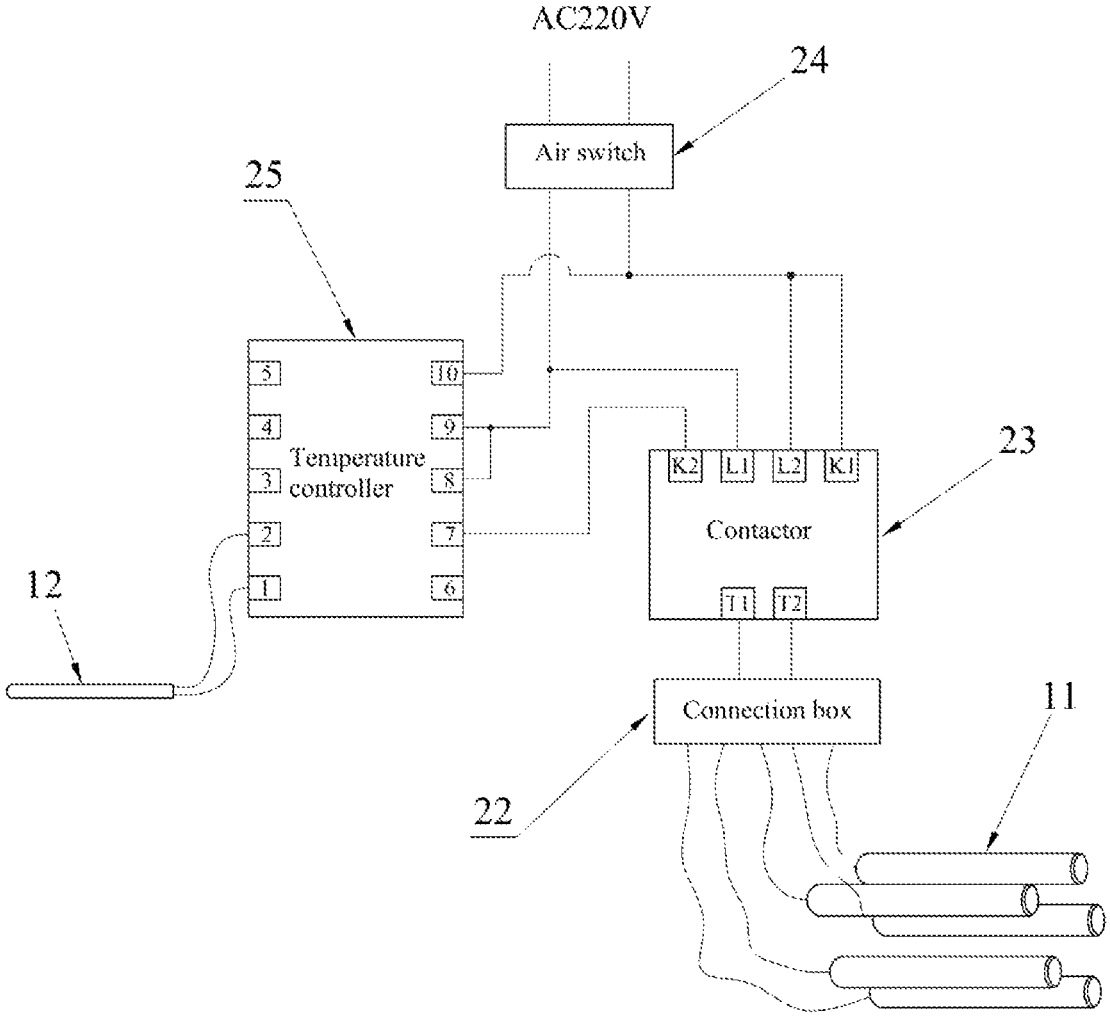
FIG. 5 is a schematic diagram showing a circuit of a heating device of the former for necking and thickening the tube end according to the embodiment.
Figure 6A:
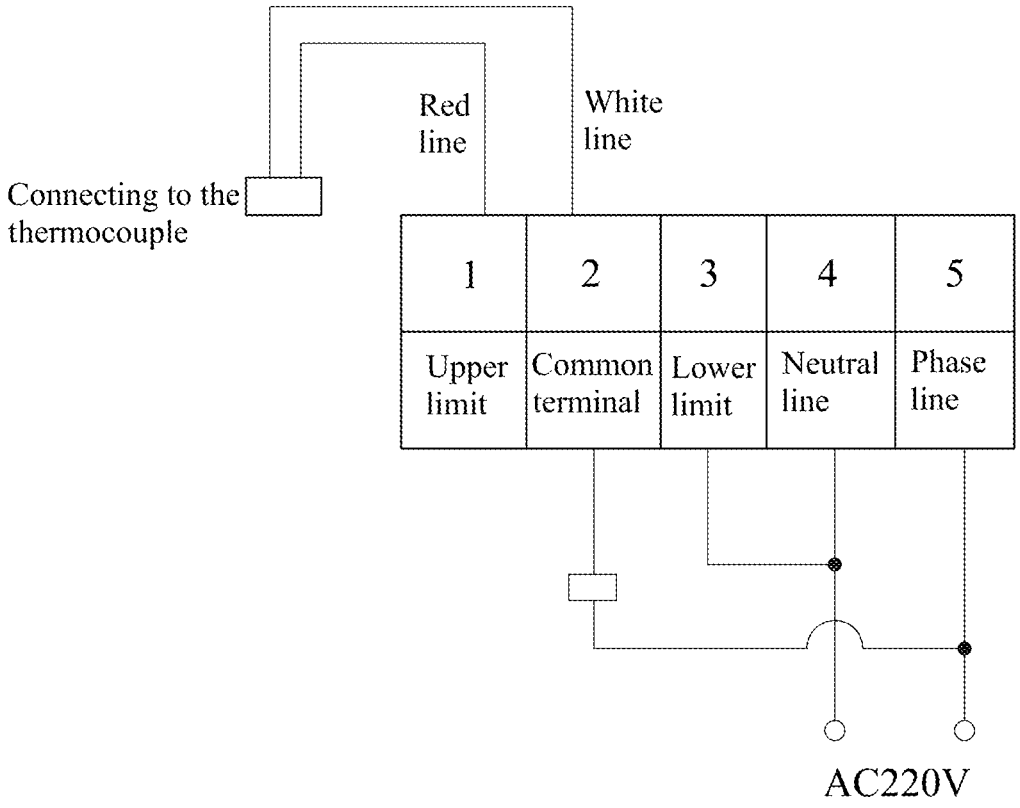
FIGS. 6A and 6B shows wiring of a temperature controller of the former for necking and thickening the tube end according to the embodiment.
Figure 6B:
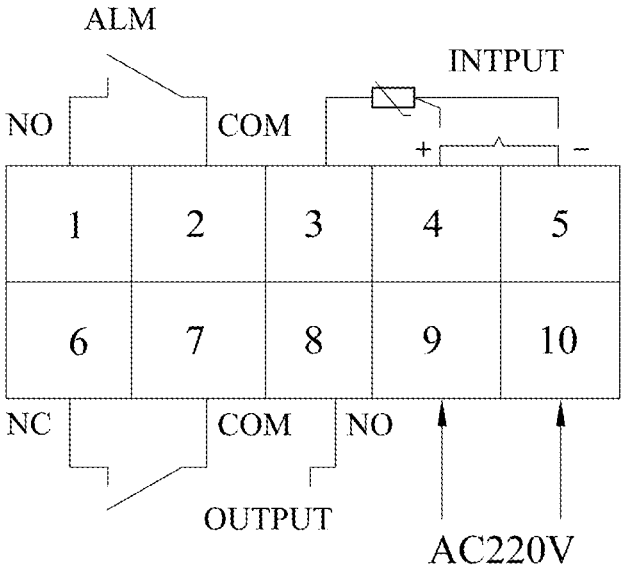

As shown in FIGS. 5 and 6A-6B, this embodiment provides the plurality of heating holes 16 and the plurality of thermometer holes 19 to control the temperature of the concave die 9. The detecting unit of the plurality of thermometer holes 19 is a thermocouple 12. The heating device includes a temperature controller 25, an air switch 24 and a contactor 23. The thermocouple 12 is connected to the temperature controller 25 through wires. The temperature controller 25 is connected to the contactor 23 through the air switch 24, and the contactor 24 is connected to the plurality of heating rods 11 through a connection box 22. The plurality of heating rods 11 are heated through the temperature controller 25, so that the temperature of the concave die 9 is constant. When the temperature of the concave die 9 is lowered, the thermocouple 12 in the plurality of thermometer holes 19 transmits the temperature signal to the temperature controller 25; then the temperature controller 25 sends a signal to control the contactor 23 to heat the plurality of heating rods 11 with an appropriate heating level, so that the forming temperature of the aluminum alloy tube blank 5 is obtained.

In this embodiment, a method for necking and thickening a tube end using the former includes the following steps:

S001: Prefabrication of the aluminum alloy tube blank 5

The aluminum alloy tube blank 5 with a certain length is cut using a tube cutter. The end face of the cut aluminum alloy tube blank 5 is perpendicular to the tube axis and is ensured to be smooth without burr.

S002: Installation of the former The cooling device 6 and the concave die 9 are fixed to the connecting plate 14 through a thread connection. The baffle plate 13 is threadedly connected to the concave die 9. The cooling device 6 and the concave die 9 are in close contact, and the axial hole of the cooling device 6 is aligned with the axial hole of the mold cavity 17.

The disc 2 is connected to the hydraulic cylinder 1. The pusher 3 is connected to the disc 2. The guide sleeve 4 is connected to the pusher 3. The aluminum alloy tube blank 5 is connected to the guide sleeve 4 in an embedded manner. The filler block 15 is threadedly connected to the ejector pin 18 and is placed in the mold cavity 17 of the concave die 9. The diameter-reduced end of the ejector pin 18 passes through the axial hole of the baffle plate 13. The axial hole of the cooling device 6 is adjusted to be aligned with the axial hole of the mold cavity 17, and the former has an axial center aligned with the axis of the hydraulic cylinder 1.

S003: Preheating and cooling of the aluminum alloy tube blank 5

The cooling liquid is supplied to the cooling device 6. The liquid inlet 8 and the liquid outlet 7 are connected to a plastic tube, respectively. The cooling liquid flows into the liquid inlet 8 and flows out of the liquid outlet 7. The plurality of heating rods 11 and the thermocouple 12 are inserted into the plurality of heating holes 16 and the plurality of thermometer holes 19, respectively. The heating device is powered on. The target temperature is set on the temperature controller 25 for heating the aluminum alloy tube blank 5, and the concave die 9 is preheated.

S004: Forming of the aluminum alloy tube blank 5

After the concave die 9 is preheated, the aluminum alloy tube blank 5 is processed for forming. In the forming process, according to the volume constancy, the length of the aluminum alloy tube blank 5 for necking the aluminum alloy tube blank 5 is calculated; then the length of the aluminum alloy tube blank 5 for thickening the aluminum alloy tube blank 5 is calculated; and the feeding displacement of the tube blank is calculated.

The aluminum alloy tube blank 5 is pushed by the hydraulic cylinder 1 to pass through the cooling device 6 and then slowly enter into the concave die 9 at high temperature. The feeding speed of the hydraulic cylinder 1 is controlled with a console, and the aluminum alloy tube blank 5 is necked and thickened by controlling the feeding displacement of the aluminum alloy tube blank 5.

It should be noted that in the forming process, the temperature controller 25 controls the temperature of the concave die 9 through the thermocouple 12. When the temperature is lower than the target temperature, the contactor 23 is controlled by the temperature controller 25 to continue to heat the concave die 9 to the target temperature through the plurality of heating rods 11.

S005: Completion of processing

After the processing is completed, the power is turned off. The supply of the cooling liquid is cut off and the filler block 15 is taken out to obtain the formed aluminum alloy tube blank 5.

For the general forming process for necking and thickening a tube, the tube is sequentially subjected to local heating, upset forging and necking in the die. This method increases the complexity and the production cost, and reduces the production efficiency. Necking the tube end after being thickened is more difficult. However, the forming method of the present disclosure is simpler, improves the material utilization rate, and reduces the machining allowance and the processing cost as well as the production cost.

It should be noted that the method and former for necking and thickening an aluminum alloy tube end of this embodiment is only illustrative of the present disclosure. The transition portion for necking and the filler block for pushing out the tube and other forming internal molds which are provided in the forming process fall in the scope of this application. The present disclosure simultaneously realizes the necking and thickening of the aluminum alloy tube, but is not limited to the aluminum alloy material, and can be realized in other plastic metal or other plastic materials.

The specific embodiments are intended to illustrate the principle and implementation of the present disclosure. The description of the above embodiments is merely for the purpose of better understanding of the present method. For those skilled in the art, the implementations and applications of the present disclosure can be modified within the spirit of the present disclosure. The present disclosure is not limited to the content of the description.

What is claimed is:

1. A former for necking and thickening a tube end, comprising:

a hydraulic cylinder, a pusher, a concave die, a filler block, a plurality of heating rods, and a heating device, wherein a cooling device is further provided between the hydraulic cylinder and the concave die; the cooling device and the concave die are both provided on a connecting plate; a through hole is provided on the cooling device and has an inner diameter equal to an inner diameter of the mold cavity; and an axial center of the pusher, an axial center of the mold cavity and a center of the through hole of the cooling device are in alignment; the hydraulic cylinder is connected to a disc; a guide sleeve is provided on the disc; the pusher is provided on the hydraulic cylinder and passes through the guide sleeve; the concave die is provided at a side of the pusher; the concave die comprises a mold cavity and a plurality of heating holes; the filler block is provided in the mold cavity; the plurality of heating rods are provided in the plurality of heating holes; and the plurality of heating rods are connected to the heating device;

wherein the filler block comprises a tapered portion and a diameter-reduced portion; the tapered portion is provided at a first end of the filler block; the tapered portion is threadedly connected to the diameter-reduced portion; and an ejector pin is further provided at a first end of the diameter-reduced portion.

2. The former of claim 1, wherein the cooling device abuts against a first end of the concave die; a baffle plate is provided at a second end of the concave die opposite to the first end of the concave die; the baffle plate abuts against the ejector pin; a liquid inlet is provided at a bottom of the cooling device, and a liquid outlet is provided at a top of the cooling device.

3. The former of claim 2, wherein the baffle plate and the concave die are provided with the plurality of heating holes which are distributed along a circumference of the mold cavity; and the baffle plate and the concave die are provided with a plurality of thermometer holes between the adjacent heating holes.

4. The former of claim 3, wherein a thermocouple is provided in the plurality of thermometer holes in the concave die; the heating device comprises a temperature controller, an air switch and a contactor; the thermocouple is electrically connected to the temperature controller; the temperature controller is connected to the contactor through the air switch; and the contactor is electrically connected to the plurality of heating rods.

5. The former of claim 4, wherein a second end of the filler block opposite to the first end of the filler block is a cylinder; a first end of the cylinder and a first end of the tapered portion are integrally formed and have the same diameter; a second end opposite to the first end of the tapered portion and a diameter-reduced end of the diameter-reduced portion are connected and have the same diameter; one end opposite to the diameter-reduced end of the diameter-reduced portion is connected to the ejector pin; the ejector pin is provided with an ejection rod having a diameter larger than the diameter of the diameter-reduced end of the diameter-reduced portion.

6. A method for necking and thickening a tube end using the former of claim 1, wherein the method comprises:

step 1: cutting a tube blank with a length using a tube cutter; wherein an end face of the cut tube blank is perpendicular to a tube axis and is smooth without burr;

step 2: fixing each of the cooling device and the concave die to the connecting plate through a thread connection; threadedly connecting a baffle plate to the concave die, wherein the cooling device and the concave die contact with each other, and an axial hole of the cooling device is aligned with an axial hole of the mold cavity;

connecting the hydraulic cylinder to the disc connected to the pusher; connecting the pusher to the guide sleeve; inserting the tube blank into the guide sleeve; threadedly connecting the filler block to the ejector pin; placing the filler block in the mold cavity, wherein a diameter-reduced end of the ejector pin passed through an axial hole of the baffle plate; the axial hole of the cooling device is adjusted to be aligned with the axial hole of the mold cavity; and the former has an axial center aligned with an axis of the hydraulic cylinder;

step 3: supplying cooling liquid to the cooling device; connecting a liquid inlet and a liquid outlet to a plastic tube, respectively, wherein the cooling liquid flows into the liquid inlet and flows out of the liquid outlet;

inserting the plurality of heating rods and a thermocouple into the plurality of heating holes and a plurality of thermometer holes, respectively; powering the heating device; setting a target temperature on a temperature controller for heating the tube blank; and preheating the concave die;

step 4: after the concave die is preheated, pushing the tube blank with the hydraulic cylinder to pass through the cooling device and then enter into the concave die, wherein a feeding speed of the hydraulic cylinder is controlled with a console, and the tube blank is necked and thickened by controlling a feeding displacement of the tube blank; and step 5: powering off after the processing is completed; stopping supplying the cooling liquid and taking out the filler block to obtain the formed tube end.

7. The method of claim 6, wherein in step 4, according to volume constancy, the length of the tube blank for necking the tube blank is calculated; then the length of the tube blank for thickening the tube blank is calculated; and the feeding displacement of the tube blank is calculated.

8. The method of claim 6, wherein in step 4, temperature of the concave die is controlled with the temperature controller using the thermocouple; when the temperature is lower than the target temperature, a contactor is controlled by the temperature controller to continue to heat the concave die to the target temperature through the plurality of heating rods.

* * * * *